US007584750B2

(12) United States Patent
Chang

(10) Patent No.: US 7,584,750 B2
(45) Date of Patent: Sep. 8, 2009

(54) BOW FOR A CROSSBOW

(75) Inventor: Chu-Wei Chang, Feng-Yuan (TW)

(73) Assignee: Poe Lang Enterprise Co., Ltd., Feng-Yuan, Taichung Hsien (TW)

( * ) Notice: Subject to any disclaimer, the term of this patent is extended or adjusted under 35 U.S.C. 154(b) by 355 days.

(21) Appl. No.: 11/526,112

(22) Filed: Sep. 22, 2006

(65) Prior Publication Data

US 2008/0072888 A1 Mar. 27, 2008

(51) Int. Cl.
*F41B 5/00* (2006.01)

(52) U.S. Cl. ..... 124/25; 124/23.1

(58) Field of Classification Search ..... 124/23.1, 124/25.6, 86, 88

See application file for complete search history.

(56) References Cited

U.S. PATENT DOCUMENTS 3,821,946 A * 7/1974 Griggs ..... 124/23.1
5,339,790 A * 8/1994 Smith ..... 124/25.6
5,433,792 A * 7/1995 Darlington ..... 124/25.6
5,507,270 A * 4/1996 Smith ..... 124/23.1
5,515,836 A * 5/1996 Martin et al. ..... 124/23.1
5,720,267 A * 2/1998 Walk ..... 124/23.1
6,360,734 B1 * 3/2002 Andrews ..... 124/23.1
6,543,432 B2 * 4/2003 Andrews et al. ..... 124/23.1
7,308,890 B1 * 12/2007 Wheeler ..... 124/23.1

* cited by examiner

*Primary Examiner*—John Ricci
(74) *Attorney, Agent, or Firm*—Charles E. Baxley

(57) ABSTRACT

A bow for a crossbow includes a retainer, two holders, two limbs, two mounting members and two fastening members. The retainer has two inclined surfaces having a receiving recess. Each holder is mounted on one of the inclined surfaces and includes a base, a cover and a semicircular pivot. The semicircular pivot is mounted detachably on the outer end of the base and corresponds to and abuts with the receiving recess of the inclined surface. Each buffer is mounted between one of the limbs and the base of a corresponding holder for absorbing the force applied to the limb and reducing stress concentration to prolong the useful life of the limb.

14 Claims, 5 Drawing Sheets

BOW FOR A CROSSBOW

BACKGROUND OF THE INVENTION

1. Field of Invention

The present invention relates to a crossbow, and more particularly to a bow for a crossbow that can prolong the useful life of a limb of the crossbow and replace a worn-off pivot of the crossbow easily.

2. Description of the Related Art

With reference to FIG. 5, a conventional crossbow comprises a stock and a bow (70). The stock has a front end and a rear end. The bow (70) is mounted on the front end of the stock and comprises two retainers (71), two pockets (74), two limbs (72), and a string (73). The retainers (71) are mounted on the front end of the stock and each has a mounting surface and a semicircular recess (711) defined in the mounting surface of the retainer (71). The pockets (74) are mounted respectively on the mounting surfaces of the retainers (71) and each has a semicircular pivot (741). The semicircular pivots (741) are formed on the pocket (74) and are mounted respectively in the recesses (711) of the retainers (711). The limbs (72) are mounted respectively on the pockets (74) and each has a distal end. The string (73) is extended between the distal ends of the limbs (72).

When the string (73) of the conventional crossbow is stretched for projecting a bolt, the limbs (72) are bent toward the rear end of the stock and the pockets (74) are pivoted respectively relative to the retainers (71). Pivotal rotation of the pockets (74) is achieved easily by the rotation of the semicircular pivots (741) in the semicircular recesses (711).

However, after a long-term of use, the semicircular pivots (741) may be worn off because the force applied to the semicircular pivots (741) from the limbs (72) is quite large. When the semicircular pivots (741) are worn off, the pockets (74) must be replaced and discarded but this is rather uneconomical. In addition, when the limbs (72) are bent, cracks may occur gradually at the place where the limbs (72) abut with the pockets (741) because of stress concentration. The limbs (72) will break when the limbs (72) are unable to bear the force applied from the string (73), and this is very dangerous for a user and reduces the useful life of the crossbow.

To overcome the shortcomings, the present invention provides a bow for a crossbow to mitigate or obviate the aforementioned problems.

SUMMARY OF THE INVENTION

The primary objective of the present invention is to provide a bow for a crossbow that can prolong the useful life of a limb of the crossbow and replace a worn-off pivot of the crossbow easily.

A bow in accordance with the present invention comprises a retainer, two holders, two limbs, two buffers, two mounting members and two fastening members. The retainer has two inclined surfaces and each inclined surface has an inner end, an outer end, two side edges, a mounting hole, a receiving recess, two flanges and a fastening hole. The mounting hole is defined in the inclined surface near the inner end of the inclined surface. The receiving recess is defined in the outer end of the inclined surface. The flanges are formed respectively on the side edges of the inclined surface. The fastening hole is defined in the inclined surface near the outer end of the inclined surface.

Each holder is mounted on one of the inclined surfaces of the retainer and comprises a base, a cover and a semicircular pivot. The base is mounted on the inclined surface of the retainer and has an inner end, an outer end, a mounting hole and a fastening hole. The mounting hole is defined through the base near the inner end of the base and is aligned with the mounting hole of the inclined surface. The fastening hole is defined through the base and is aligned with the fastening hole of the inclined surface. The cover is mounted on the base and has an inner end, an outer end, two side edges and a mounting hole. The mounting hole is defined through the cover near the inner end of the cover and is aligned with the mounting hole of the base. The semicircular pivot is mounted detachably on the outer end of the base and corresponds to and abuts with the receiving recess of the inclined surface.

Each limb is mounted in one of the holders, extends longitudinally and has an inner end mounted in the holder.

Each buffer is mounted between one of the limbs and the base of a corresponding holder in which the limb is mounted and has a middle, a mounting hole and a fastening hole. The mounting hole is defined through the buffer and is aligned with the mounting hole in the base of the holder. The fastening hole is defined through the buffer and is aligned with the fastening hole in the base of the holder.

Each mounting member comprises a bolt. The bolt is extended through the mounting holes in one of the buffers and in the base and cover of a corresponding holder in which the buffer is mounted and is screwed into the mounting hole in a corresponding inclined surface on which the holder is mounted.

Each fastening member comprises a bolt. The bolt is extended through the fastening holes in one of the buffers and in the base of a corresponding holder in which the buffer is mounted and is screwed into the fastening hole in a corresponding inclined surface of the retainer on which the holder is mounted.

Other objectives, advantages and novel features of the invention will become more apparent from the following detailed description when taken in conjunction with the accompanying drawings.

DETAILED DESCRIPTION OF THE INVENTION

Figure 1:
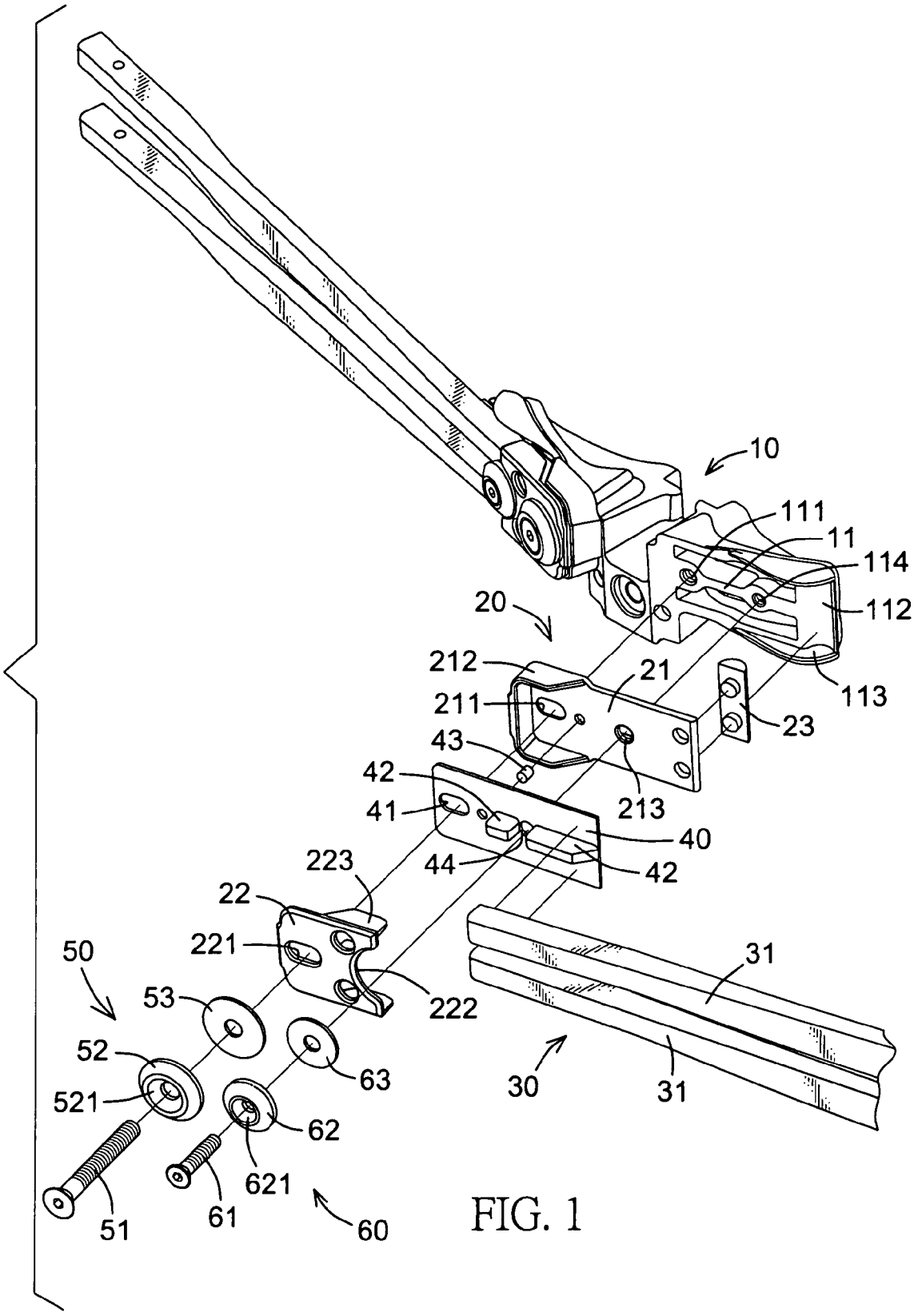
FIG. 1 is an exploded perspective view of a first embodiment of a bow for a crossbow in accordance with the present invention.
Figure 2:
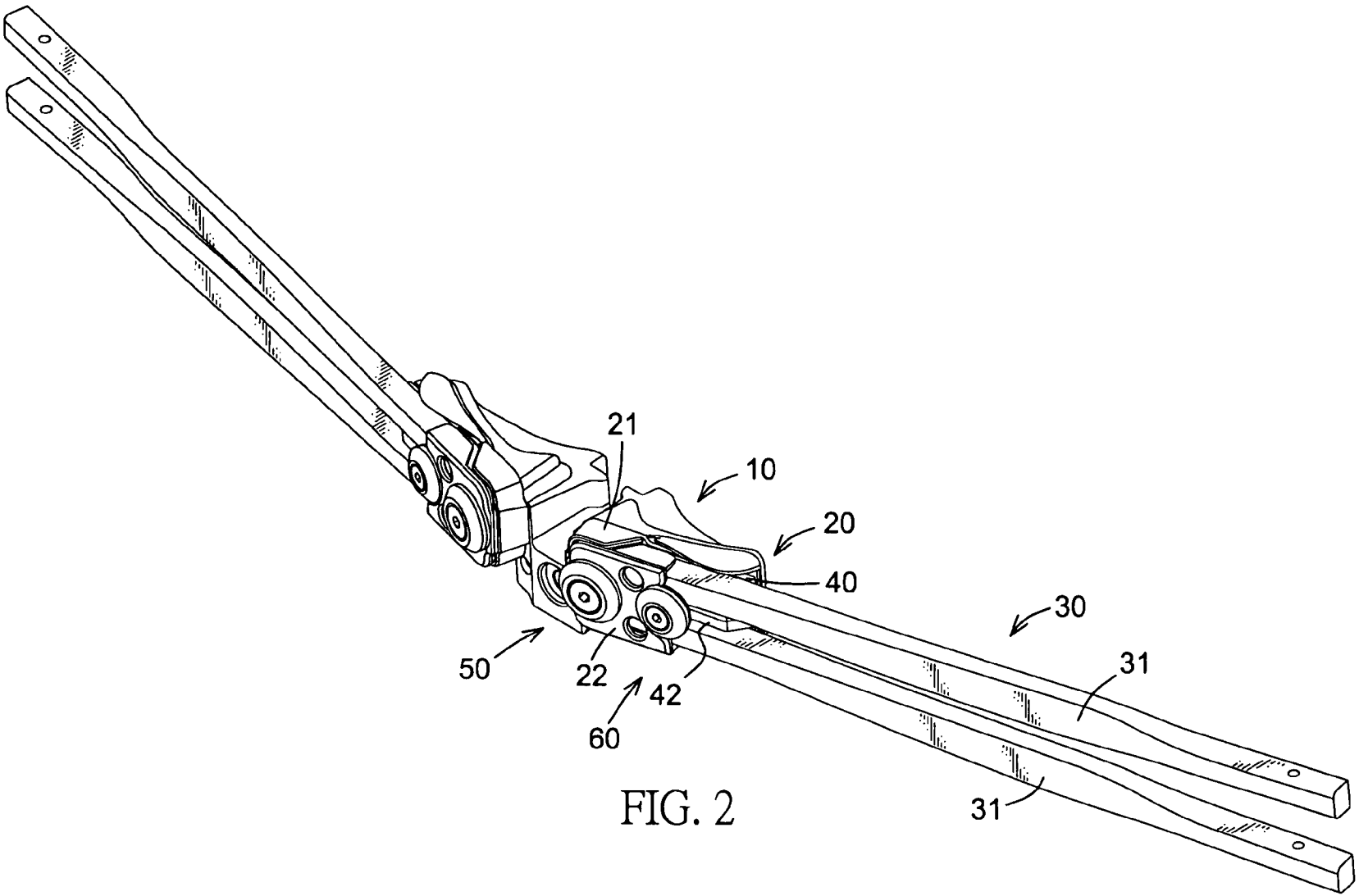
FIG. 2 is a perspective view of the first embodiment of the bow for a crossbow in FIG. 1.
Figure 3:
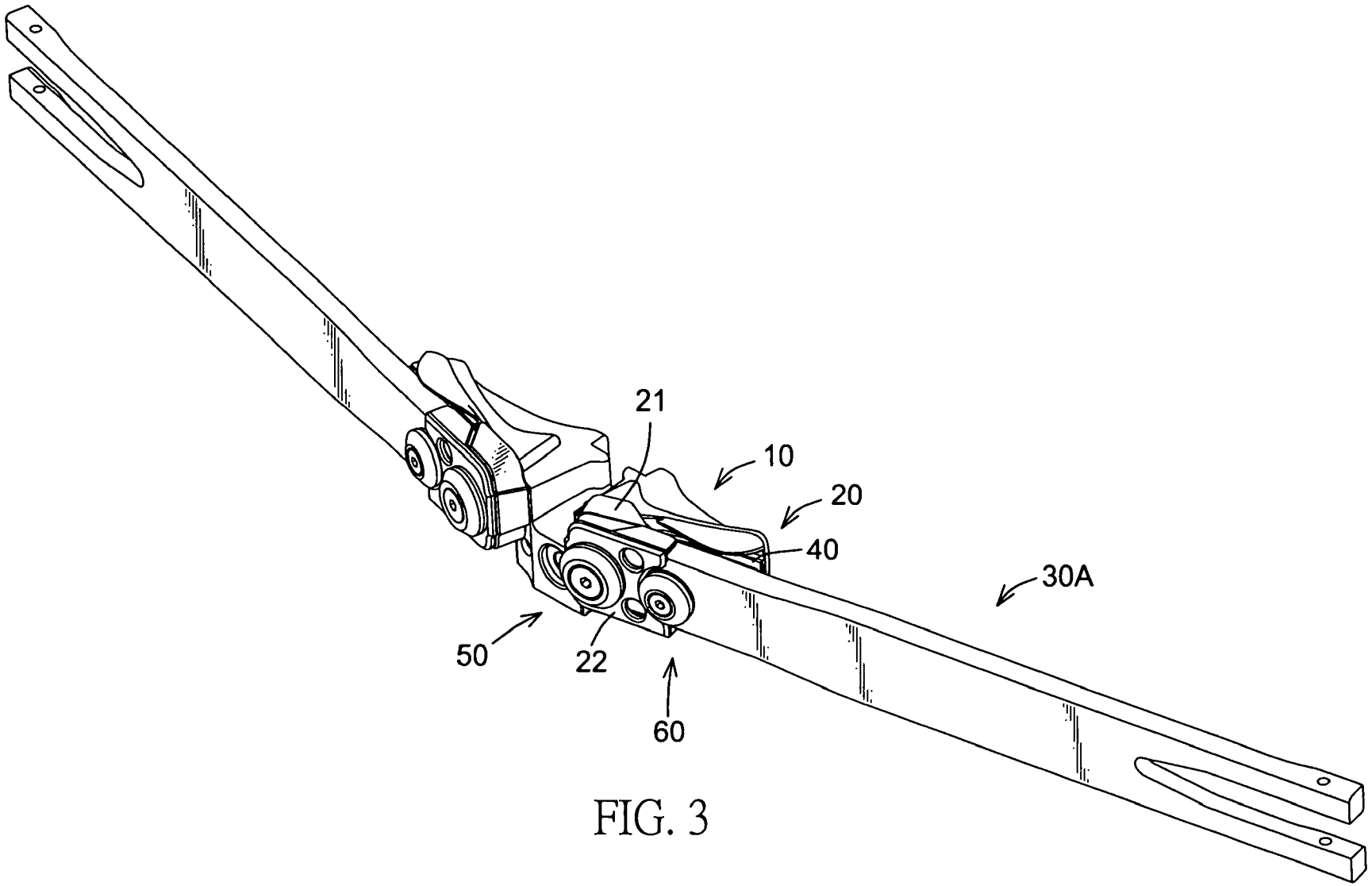
FIG. 3 is a perspective view of a second embodiment of a bow for a crossbow in accordance with the present invention.

With reference to FIGS. 1, 2 and 3, a bow for a crossbow in accordance with the present invention comprises a retainer (10), two holders (20), two limbs (30, 30A), two buffers (40), two mounting members (50) and two fastening members (60). The retainer (10) has two inclined surfaces (11). Each inclined surface (11) has an inner end, an outer end, two side edges, a mounting hole (111), a receiving recess (112), two flanges (113) and a fastening hole (114). The mounting hole (111) is defined in the inclined surface (11) near the inner end of the inclined surface (11). The receiving recess (112) is defined in the outer end of the inclined surface (11). The flanges (113) are formed respectively on the side edges of the inclined surface (11) and the receiving recess (112) is defined between the flanges (113). The fastening hole (114) is defined in the inclined surface (11) near the outer end of the inclined surface (11) and is aligned longitudinally with the mounting hole (111) in the inclined surface (11).

Each holder (20) is mounted on one of the inclined surfaces (11) and comprises a base (21), a cover (22) and a semicircular pivot (23). The base (21) is mounted on the inclined surface (11) and has an inner end, an outer end, a mounting hole (211), an positioning flange (212) and a fastening hole (213). The mounting hole (211) is defined through the base (21) near the inner end of the base (21) and is an elongated hole extending longitudinally and aligned with the mounting hole (111) in the inclined surface (11). The positioning flange (212) is formed around the inner end of the base (21). The fastening hole (213) is defined through the base (21) and is aligned with the fastening hole (114) in the inclined surface (11).

The cover (22) is mounted on the base (21) and has an inner end, an outer end, two side edges and a mounting hole (221) and may has a notch (222) and two positioning flanges (223). The mounting hole (221) is defined through the cover (22) near the inner end of the cover (22) and is an elongated hole extending longitudinally and aligned with the mounting hole (211) in the base (21). The notch (222) is defined in the outer end of the cover (22) and corresponds to the mounting hole (213) in the base (21). The positioning flanges (223) are formed respectively on the side edges of the cover (22) on the outer end of the cover (20) and correspond to the positioning flange (212) on the base (21).

The semicircular pivot (23) is made of plastic material and is mounted detachably on the outer end of the base (21). The semicircular pivot (23) corresponds to and abuts with the receiving recess (112) in the corresponding inclined surface (11). When the semicircular pivot (23) is worn off, the semicircular pivot (23) can be detached from the base (21) and replaced easily and conveniently without discarding the entire holder (20).

Each limb (30, 30A) is mounted in one of the holders (20) and extends longitudinally.

In a first embodiment of the bow in accordance with the present invention, each limb (30) comprises two limb rods (31). Each limb rod (31) has an inner end. The inner ends of the limb rods (31) are mounted in the holder (20).

In a second embodiment of the bow in accordance with the present invention, each limb (30A) has an inner end mounted in the holder (20).

Each buffer (40) is mounted between one of the limbs (30, 30A) and the base of a corresponding holder (20) in which the limb (30, 30A) is mounted for absorbing the force applied to the limb (30, 30A) and reducing stress concentration. The buffer (40) is made of plastic material and has a middle, a mounting hole (41) and a fastening hole (44) and may have a positioning element (43) and a positioning rib (42). The mounting hole (41) is defined through the buffer (40) and is an elongated hole extending longitudinally and aligned with the mounting hole (211) in the base (21) of the holder (20). The fastening hole (44) is defined through the buffer (40) and is aligned with the fastening hole (213) in the base (21) of the holder (20). The positioning element (43) is mounted in the buffer (40) and the base (21) of the holder (20) for positioning the buffer (40) on the base (21).

In the first embodiment, the positioning rib (42) is formed on the middle of the buffer (40) and abuts with the limb rods (31) of the corresponding limb (30) for separating the limb rods (31).

Each mounting member (50) comprise a bolt (51) and may have a washer (52) and a spacer (53). The bolt (51) is extended through the mounting holes (41, 211, 221) in one of the buffers (40) and in the base (21) and cover (22) of a corresponding holder (20) in which the buffer (40) is mounted and is screwed into the mounting hole (111) in a corresponding inclined surface (11) on which the holder is mounted. When the limb (30, 30A) is bent, the bolt (51) is allowed to move slightly relative to the elongated mounting holes (41, 211, 221) and this prevents the bolt (51) from bending. The washer (52) is mounted around the bolt (51) and has a conical surface (521). The conical surface (521) of the washer (52) is mounted around the bolt (51) and allows the washer (52) to pivot slightly when the limb (30, 30A) is bent. The spacer (53) is mounted around the bolt (51) between the washer (52) and the cover (22).

Each fastening member (60) comprises a bolt (61) and may have a washer (62) and a spacer (63). The bolt (60) is extended through the fastening holes (213, 44) in one of the buffers (40) and in the base (21) of a corresponding holder (20) in which the buffer (40) is mounted and is screwed into the fastening hole (114) in the corresponding inclined surface (11) on which the holder is mounted. The washer (62) is mounted around the bolt (61) and has a conical surface (621). The conical surface (621) of the washer (62) is mounted around the bolt (61) and allows the washer (62) to pivot slightly when the limb (30, 30A) is bent. The spacer (63) is mounted around the bolt (61) between the washer (62) and the limb (30, 30A).

Figure 4:
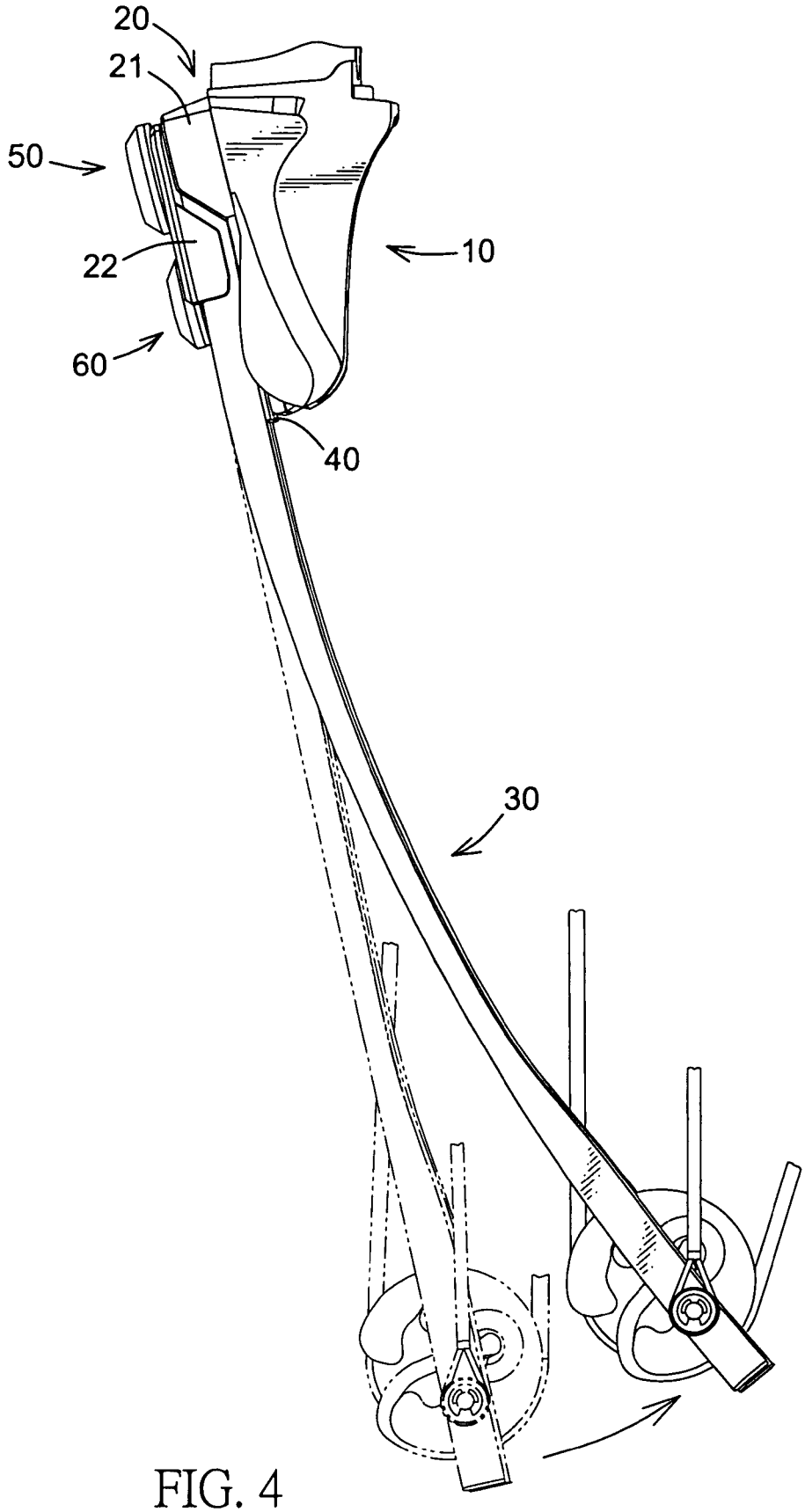
FIG. 4 is an operational top view of the bow for a crossbow in FIG. 1 with the limb been bent.
Figure 5:
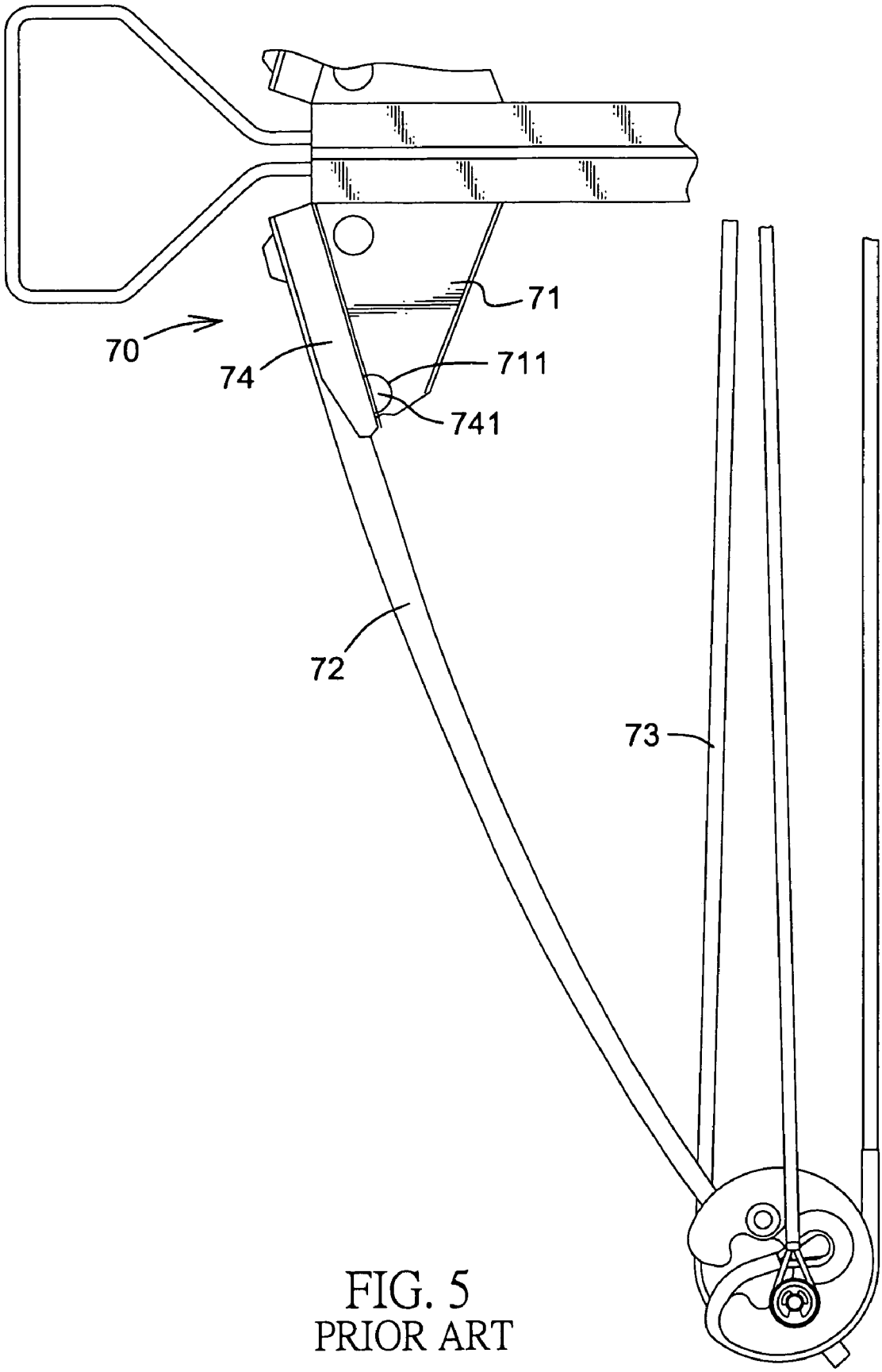
FIG. 5 PRIOR ART
FIG. 5 is a top view of a conventional bow for a crossbow in accordance with a prior art.

With further reference to FIG. 4, when the limbs (30, 30A) are bent, the holders (20) holding the limbs (30, 30A) pivot slightly. The semicircular pivots (23) mounted detachably on the bases (22) of the holders (20) allow the holders (20) to pivot easily and can be replaced conveniently without discarding the holders (20). In addition, the buffers (40) mounted between the limbs (30, 30A) and the bases (21) of the holders (20) can reduce stress concentration of the limbs (30, 30A) and prolong the useful life of the limbs (30, 30A). Furthermore, because the limbs (30, 30A) are not easily broken, the crossbow with the bow in accordance with the present invention is save in use.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A bow for a crossbow comprising a retainer having
two inclined surfaces and each having
an inner end;
an outer end;
two side edges;
a mounting hole being defined in the inclined surface near the inner end of the inclined surface;
a receiving recess being defined in the outer end of the inclined surface;
two flanges being formed respectively on the side edges of the inclined surface, wherein the receiving recess is defined between the flanges; and
a fastening hole being defined near the inclined surface near the outer end of the inclined surface;
two holders mounted respectively on the inclined surfaces and each comprising;
a base being mounted on a corresponding inclined surface on which the holder is mounted and having
an inner end;
an outer end;

a mounting hole being defined through the base near the inner end of the base and aligned with the mounting hole in the corresponding inclined surface; and a fastening hole being defined through the base and aligned with the fastening hole of the corresponding inclined surface;

a cover being mounted on the base and having an inner end;

an outer end;

two side edges; and a mounting hole being defined through the base near the inner end of the base and aligned with the mounting hole in the base; and a semicircular pivot being mounted detachably on the outer end of the base and corresponding to and abutting with the receiving recess of the inclined surface;

two limbs mounted respectively on the holders, extending longitudinally and each limb having two limbs rods, and each limb rod having an inner end mounted in a corresponding holder on which the limb is mounted;

two buffers each mounted between one of the limbs and the base of a corresponding holder and having a middle;

a mounting hole being defined through the buffer and aligned with the mounting hole in the base of the corresponding holder; and a fastening hole being defined through the buffer and aligned with the fastening hole in the base of the corresponding holder; and a positioning rib being formed on the middle of the buffer and abutting with corresponding limb rods;

two mounting members each comprising a bolt being extended through the mounting holes in one of the buffers and in the base and cover of a corresponding holder and screwed into the mounting hole in a corresponding inclined surface; and two fastening members each comprising a bolt being extended through the fastening hole in one of the buffers and in the base of a corresponding holder and screwed into the fastening hole in a corresponding inclined surface.

2. The bow as claimed in claim 1, wherein the fastening hole in the each inclined surface is aligned longitudinally with the mounting hole in the inclined surface.

3. The bow as claimed in claim 2, wherein the cover of each holder further has a notch defined in the outer end of the cover and corresponding to the mounting hole of the base.

4. The bow as claimed in claim 3, wherein the base of each holder further has a positioning flange formed around the inner end of the base.

5. The bow as claimed in claim 4, wherein the cover of each holder further has two positioning flanges formed respectively on the side edges of the cover on the outer end of the cover and corresponding to the positioning flange of the base.

6. The bow as claimed in claim 5, wherein each fastening member further comprises a washer and a spacer; and the washer has a conical surface.

7. The bow as claimed in claim 6, wherein each mounting member further comprises a washer and a spacer; and the washer has a conical surface.

8. The bow as claimed in claim 7, wherein

Each buffer further comprises a positioning element mounted in the buffer and the base of a corresponding holder.

9. The bow as claimed in claim 8, wherein

The fastening holes in the base and cover of the holders and the buffers are elongated holes extending longitudinally.

10. The bow as claimed in claim 9, wherein

The semicircular pivot of each holder is made of plastic material.

11. The bow as claimed in claim 1, wherein each buffer further comprises a positioning element mounted in the buffer and the base of a corresponding holder.

12. The bow as claimed in claim 1, wherein the cover of each holder further has a notch defined in the outer end of the cover and corresponding to the mounting hole of a corresponding base.

13. A bow for a crossbow comprising a retainer having two inclined surfaces and each having an inner end; an outer end;

two side edges;

a mounting hole being defined in the inclined surface near the inner end of the inclined surface;

a receiving recess being defined in the outer end of the inclined surface;

two flanges being formed respectively on the side edges of the inclined surface, wherein the receiving recess is defined between the flanges; and a fastening hole being defined near the inclined surface near the outer end of the inclined surface;

two holders mounted respectively on the inclined surfaces and each comprising a base being mounted on a corresponding inclined surface on which the holder is mounted and having an inner end;

an outer end;

a mounting hole being defined through the base near the inner end of the base and aligned with the mounting hole in the corresponding inclined surface; and a fastening hole being defined through the base and aligned with the fastening hole of the corresponding inclined surface;

a cover being mounted on the base and having an inner end;

an outer end;

two side edges; and a mounting hole being defined through the base near the inner end of the base and aligned with the mounting hole in the base; and a semicircular pivot being mounted detachably on the outer end of the base and corresponding to and abutting with the receiving recess of the inclined surface;

two limbs mounted respectively on the holders, extending longitudinally and each having an inner end being mounted in a corresponding holder on which the limb is mounted;

two buffers each mounted between one of the limbs and the base of a corresponding holder and having a middle;

a mounting hole being defined through the buffet and aligned with the mounting hole in the base of the corresponding holder; and a fastening hole being defined through the buffer and aligned with the fastening hole in the base of the corresponding holder;

two mounting members each comprising a bolt being extended through the mounting holes in one of the buffers and in the base and cover of a corresponding holder and screwed into the mounting hole in a corresponding inclined surface; and two fastening members each comprising a bolt being extended through the fastening hole in one of the buffers and in the base of a corresponding holder and screwed into the fastening hole in a corresponding inclined surface, wherein the fastening hole in the each inclined surface is aligned longitudinally with the mounting hole in the inclined surface, wherein each limb comprises two limb rods; and each limb rod has an inner and mounted in a corresponding holder, wherein each buffer further has a positioning rib formed on the middle of the buffer and abutting with corresponding limb rods.

14. The bow as claimed in claim 13 wherein each limb comprises two limb rods; and each limb rods has an inner end mounted in a corresponding holder wherein the buffer further has a positioning rib formed on the middle of the buffer and abutting with the limb rods of a corresponding limb.

* * * * *